US005317642A

United States Patent [19]

Danley et al.

[11] Patent Number: 5,317,642

[45] Date of Patent: May 31, 1994

[54] LOUDSPEAKERS HAVING TORQUE DRIVE RADIATORS

[75] Inventors: Thomas J. Danley, Highland Park; Charles A. Rey, Riverwoods, both of Ill.

[73] Assignee: Intersonics Incorporated, Northbrook, Ill.

[21] Appl. No.: 21,884

[22] Filed: Feb. 24, 1993

[51] Int. Cl.[5] ..... H04R 25/00

[52] U.S. Cl. ..... 381/182; 381/186; 381/192

[58] Field of Search ..... 381/195, 182, 192, 194, 381/197, 186

[56] References Cited

FOREIGN PATENT DOCUMENTS 0090199 5/1979 Japan ..... 381/195

0325543 2/1930 United Kingdom ..... 381/192

*Primary Examiner*—Curtis Kuntz

*Assistant Examiner*—Sinh Tran

*Attorney, Agent, or Firm*—Juettner Pyle & Lloyd

[57] ABSTRACT

A loudspeaker has a rigid sound radiator having a free edge and a electromagnetic drive mounted on an opposed hub edge and arranged to produce a torque on the radiator. Either a coil or a permanent magnet of the drive is mounted directly on the hub edge and has a radius which is substantially smaller than the radius of the radiator.

13 Claims, 5 Drawing Sheets

Fig. 5
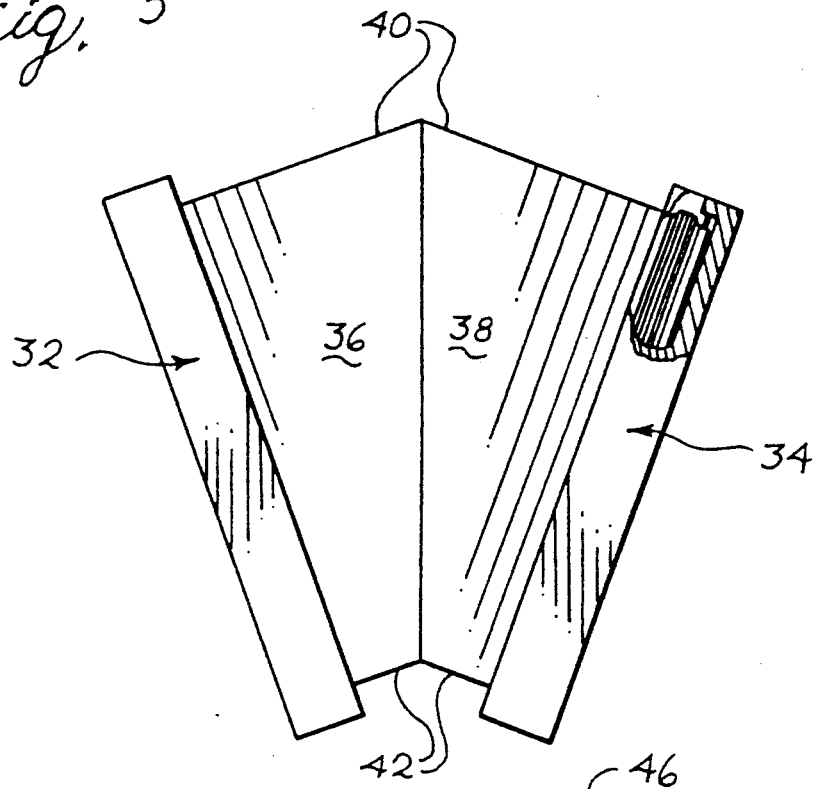
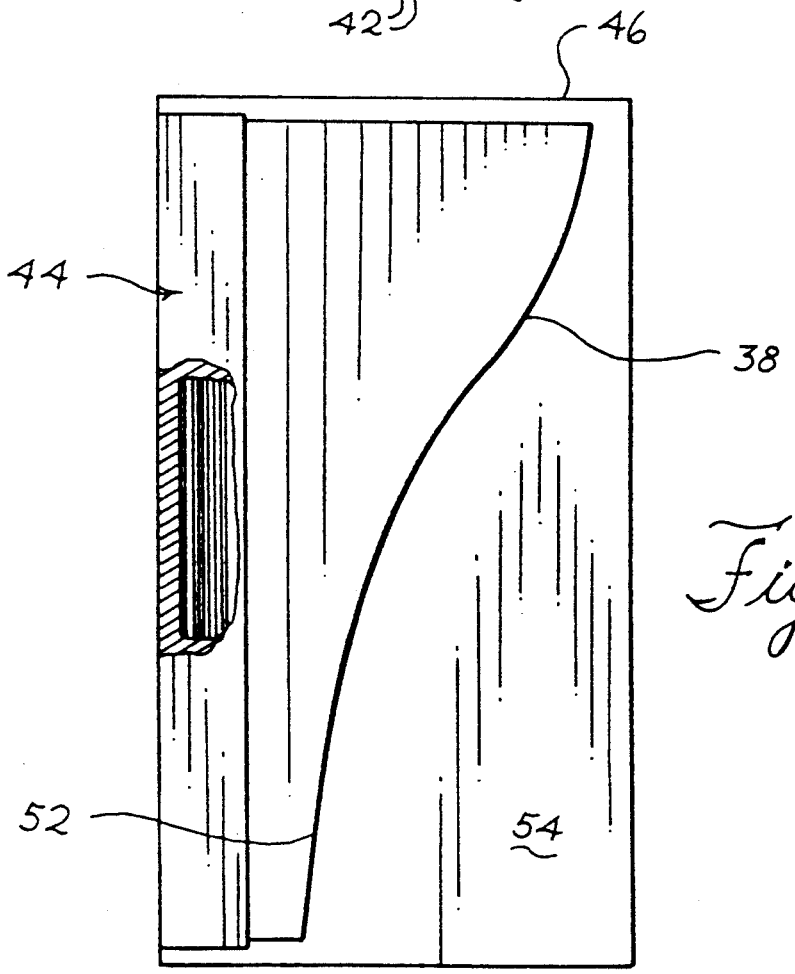
Fig. 6

LOUDSPEAKERS HAVING TORQUE DRIVE RADIATORS

BACKGROUND OF THE INVENTION

Conventional loudspeakers use a voice coil connected to a sound radiating cone or dome, with the voice coil being immersed in the field of a permanent magnet. An electrical audio signal is passed through the coil, causing linear motion of the coil and vibrations in the radiator.

The efficiency of a conventional linear drive loudspeaker is related primarily and linearly to the mass of the moving components, the radiating area, and the efficiency of the solenoid motor. However, even with the use of light weight materials in the cones and coil, and the use of strong magnets, the potential efficiency of conventional speakers is very low and is usually less than a few percent. Moving mass constraints impose a limit on the amount of wire which may be used in the voice coil.

Departures from conventional technology may be found in U.S. Pat. Nos. 4,564,727 and 4,763,358. In both patents, the shaft of a separate commutated electrical motor is connected to a radiator to generate sound. In U.S. Pat. No. 4,564,727, the rotary motion of the motor is converted to linear motion to drive a radiator. In U.S. Pat. No. 4,763,358, the shaft of the motor is connected to the shaft of a rotary vane disposed in tube having a baffle. The tube has a port on one side of a baffle through which sound is emitted. These devices are most suitable for a production of low frequency sound at high intensities, since excursions of the motor are unlimited, and the separate motor has a higher efficiency than a voice coil and magnet drive.

SUMMARY OF THE INVENTION

In accordance with the present invention, a sound radiator is operated in a fundamentally different manner than a voice coil speaker. The radiator is constructed from a relatively stiff, light weight and substantially planar material. Rather than moving the radiator in a linear fashion, a torque, responsive to an audio signal, is applied along or near one edge of the radiator to produce rotary vibratory motion of the radiator. The torque is produced by an electromagnetic drive comprising a magnetic dipole at right angles to the force of a magnetic field, and one of the components of the drive is mounted directly on the radiator.

In a preferred embodiment, a conductive coil is wrapped directly around one edge or hub of the radiator, and the coil is disposed between the opposite poles of a magnet. An electrical audio signal in the coil causes alternating torque to be applied at or near one edge of the radiator. Since the coil is positioned and confined near the edge of the radiator and has a radius which is small relative to the overall radius of the radiator, a mechanical transformer effect is achieved, with the greatest movement taking place at the more remote or opposite edge portion of the radiator. In this rotary system, the torque exerted by the coil is proportional to the radius of the coil whereas the inertial contribution is due to the moment of inertia which is proportional to the radius squared. This relationship is not true of conventional linear drives, in which the inertia is directly proportional to the moving mass of the voice coil and cone, and parts of the suspension components of the system. Two or more radiators of the present invention may be mounted with the free edges being closely adjacent to one another. Also, the motion from one or more units may be used to drive a secondary radiator.

In comparison to the conventional voice coil speaker having the same size of radiator, the torque drive speaker of the present invention offers numerous distinct advantages. The speaker can be fundamentally more efficient, may be constructed from inexpensive materials, and the cost of manufacture is low. The wire in the coil area may be spread over a relatively long distance and/or at greater concentrations to aid in heat dissipation and to improve performance and power handling. Smaller and less expensive permanent magnets may be employed than in a conventional speaker. The audio range of the speaker may be substantially improved. Various sizes and shapes of speakers can easily be prepared, including highly compact versions, since a flat, rigid radiator may be employed. No elaborate framework or suspension system is required, and system nonlinearities are improved. The radiator may be constructed from low density, stiff materials and may be tapered toward the radiating edge, since the forces at such edge are relatively low.

The loudspeaker of the present invention differs from the rotary transducer shown in U.S. Pat. No. 4,763,358 in that an active portion of the electromagnetic drive of the present invention, either the coil or the magnet, is mounted directly on the radiator, and no separate motor or drive shaft is required.

THE DRAWINGS

FIG. 5 is a top view of a pair of side by side units showing different forms of radiators.

FIG. 6 is a top view illustrating a single unit in an enclosing with a variable opening in the baffle.

DESCRIPTION OF THE PREFERRED EMBODIMENTS

Figure 1:
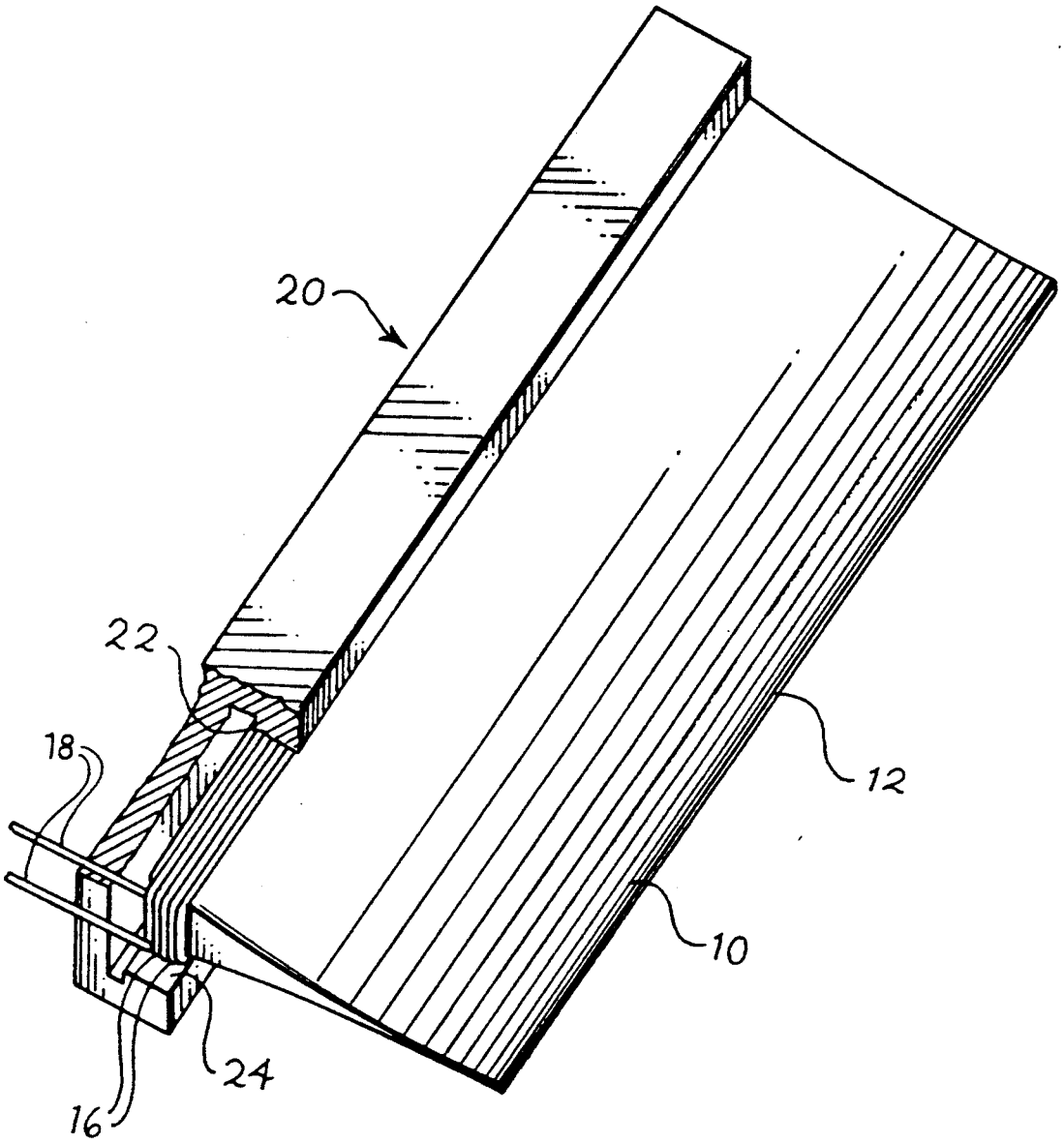
FIG. 1 is a perspective view of the loudspeaker of the present invention.

FIGS. 1 through 4 show the basic unit of the loudspeaker of the present invention. The unit comprises a radiator panel 10 which is preferably of light weight and stiff or rigid material. For example, inexpensive plastic foams may be employed, although many other suitable materials and composites are available. The radiator 10 has a free edge or remote portion 12 near which maximum vibrations occur as the radiator generates sound directly into the air. The radiator may be tapered toward the free edge 12 wherein the inertial moments may be kept relatively small.

Means are provided for exerting or imparting a rotary torque on the radiator, said means being preferably located at or near an edge 14 of the radiator in a spaced relation from the free edge 12. As shown, a plurality of continuous turns 16 of a conductive elements such as insulated wire are wrapped around the body of the radiator near the hub edge 14 to provide a coil having upper and lower exposed elements on the opposed surfaces of the radiator. The turns, which are preferably disposed in a parallel relationship, may extend the entire length of the radiator, which may be any desired length, and may be provided in a single layer or in a number of layers as shown. The ends of the coil 16 terminate in leads 18, which are connected to a suitable audio source, such as the output of an amplifier.

Figure 2:
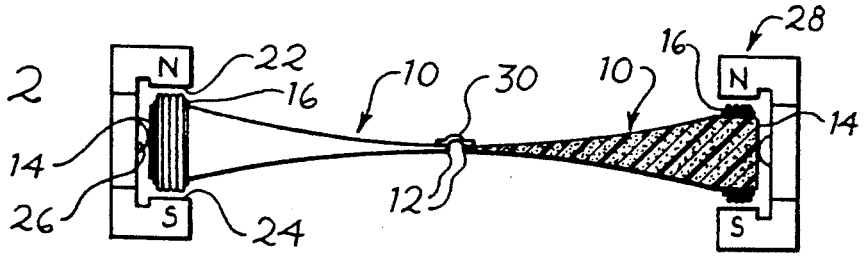
FIG. 2 is a partial transverse sectional view through the loudspeaker shown in FIG. 1 and additionally showing two units mounted side by side.

Permanent magnet structure 20 having opposite or North and South poles 22 and 24 is provided in opposition to, slightly spaced from, and coextensive with the respective upper and lower longitudinal portions of the coil. Thus, current in one direction through one side of the coil and in a reverse direction through the other side causes a rotary torque to be exerted around an axis near the longitudinal edge 14 of the radiator 10. An alternating or audio signal to the coil causes an alternating torque to be applied, resulting in vibration and generation of sound waves over the radiator and especially near a remote portion, or the free edge. As shown in FIG. 2, the edge 14 of the radiator may be held in the correct or centered position between the magnet poles 22 and 24 by means of a flexible element 26 connected between said edge and the magnet structure. For example, a flexible curable silicone adhesive or other suitable flexible substrate may be employed.

It may be seen that the mass of coil windings 16 is concentrated near the hub edge 14 of the radiator, and the rotational radius or width of the coil is very small in comparison with the overall rotational radius or width of the radiator. Also, it will be obvious that the amount of wire used in the coil and the radius of the radiator are easily adjusted variables. The overall length in the direction of the axis of rotation can easily be varied, depending on the application.

Since this is a rotary system, it may be seen that small rotary motions near the hub edge 14 are transformed into larger motions at or near the remote portion free edge, with the torque at any point being proportional to the radius, and the moment of inertia being in proportion to the radius squared. Thus, unlike a linear drive, it is possible to concentrate the coil around a small transverse radius or width and thereby reduce its inertial effects in order to obtain a very substantial improvement in efficiency.

Figure 3:
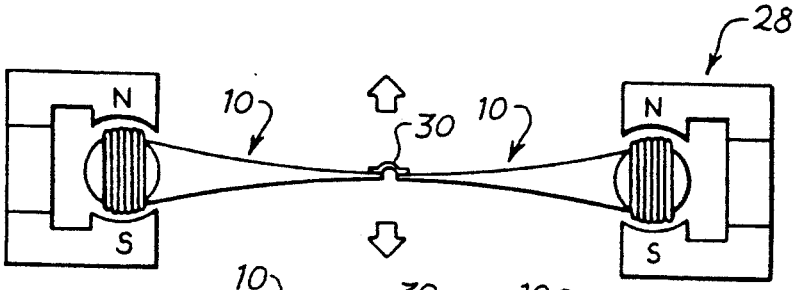
FIG. 3 is an end view similar to FIG. 2 showing certain modifications.
Figure 4:
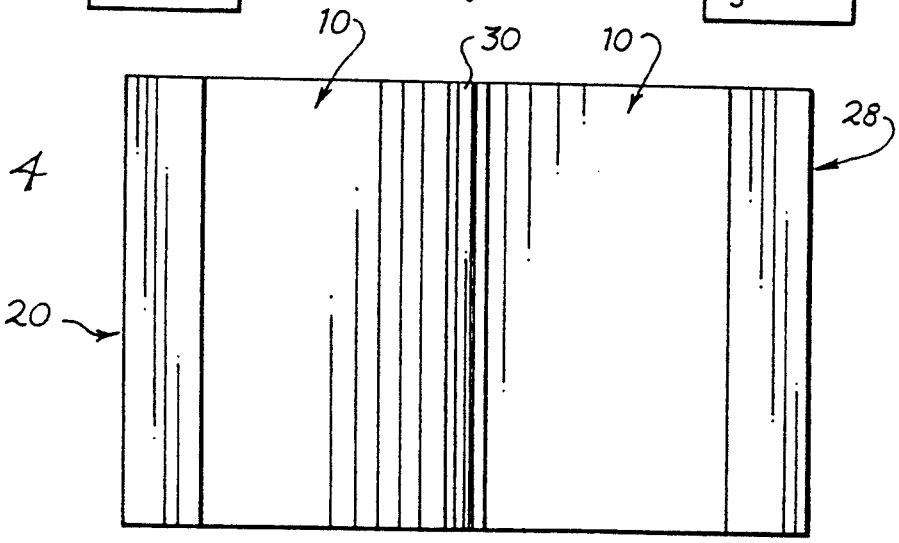
FIG. 4 is a top view of the loudspeaker shown in FIG. 2.

FIGS. 2, 3 and 4 show the possibility of mounting a second unit 28, with the free edges 12 of the units being closely adjacent to one another. A flexible web 30, in the form of an elongated, U-shaped strip or other expandable connector, may be secured between the adjacent edges. The coils of the respective drives are connected together in such a fashion such that the radiators will be driven in phase.

FIG. 3 shows a modification of the hub 14 and the poles 19 and 21 of the magnet. The hub 14 may have a rounded convex shape, and the poles 19 and 21 may have a concave curvature for a more efficient operation.

FIG. 5 shows a pair of drives 32 and 34 having radiators 36 and 38 with free edges being closely adjacent. In this embodiment, however, the radius of the radiators at one end 40 is greater than the radius at the other end 42, and the drives 32 and 34 are non-parallel. The use of a varying radius or width may aid in the production of a wider spectrum of sound, with the high frequencies being produced more effectively in the zone having a smaller radius.

Since sound is radiated from the radiators in both directions like the cone of a conventional speaker, it is usually desirable to enclose one side or make use of a baffle. FIG. 6 shows a single drive 44 mounted in a face of a box enclosure 46. The free edge 38 of the radiator 50 is positioned closely adjacent to the edge 52 of a baffle 54 mounted in the same face of the box. This embodiments also illustrates the possibility of using a curved free edge from a small to a larger radius to more effectively and efficiently cover a wide frequency range.

Figure 7:
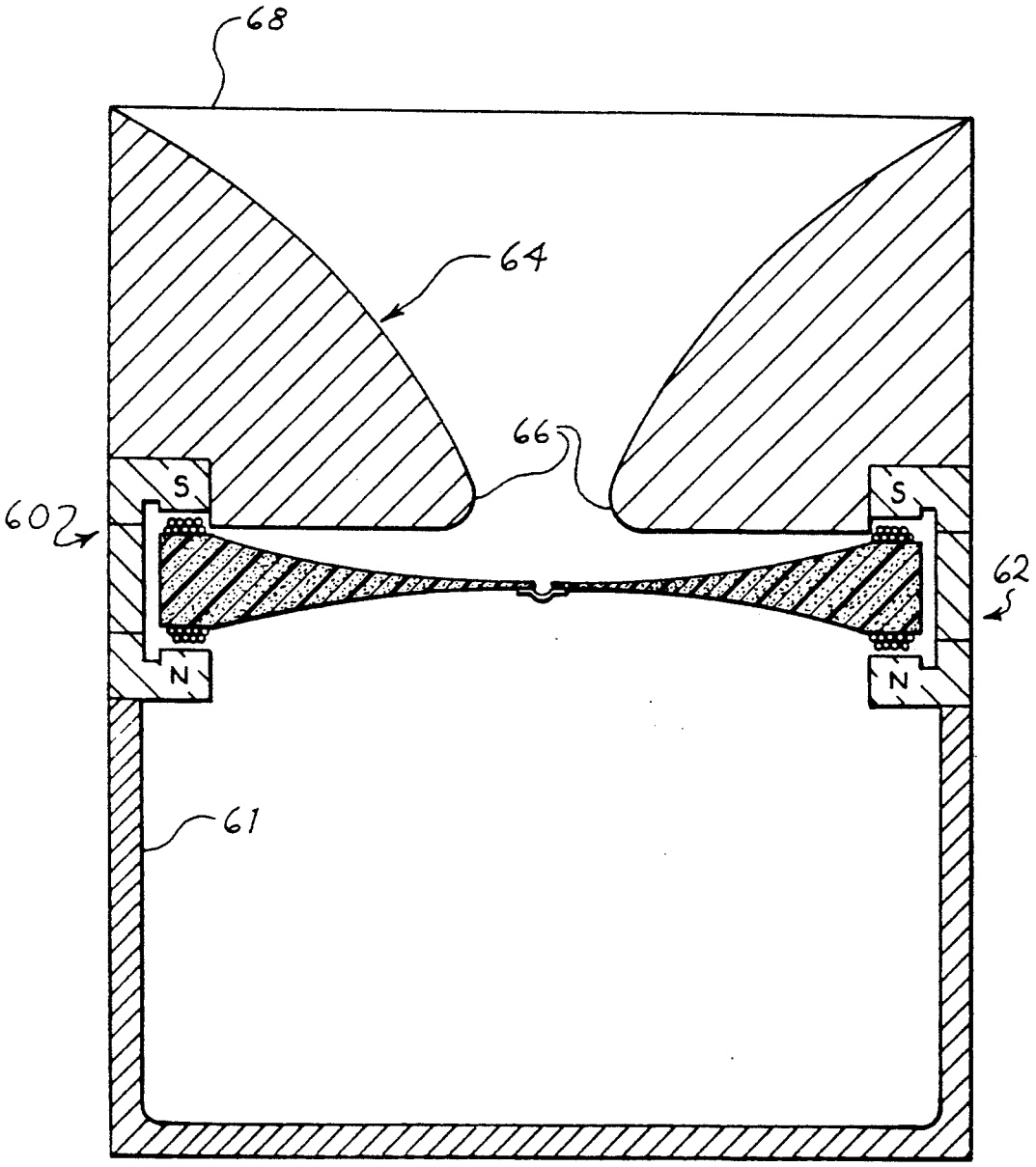
FIG. 7 is a vertical section of a pair of units in an enclosure with horn loading.

FIG. 7 shows the possibility of horn loading the sound of a pair of units 60 and 62 which are arranged as discussed in the previous embodiments. The units are mounted in the face of an enclosure 61, and a horn 64 having a narrow throat 66 near the units and a wider mouth 68 away from the units is provided on the radiation side of the units. The shape of the horn would typically conform to the shape of the speaker and, while usually circular in cross-section, it could preferably be oblong or rectangular.

Figure 8:
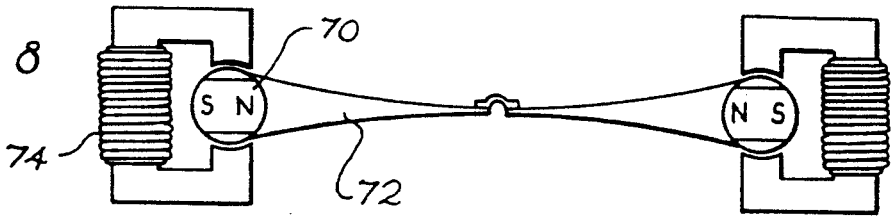
FIG. 8 is an end view of a pair of loudspeakers in which the drive is constructed in accordance with another embodiment of the present invention.
Figure 9:
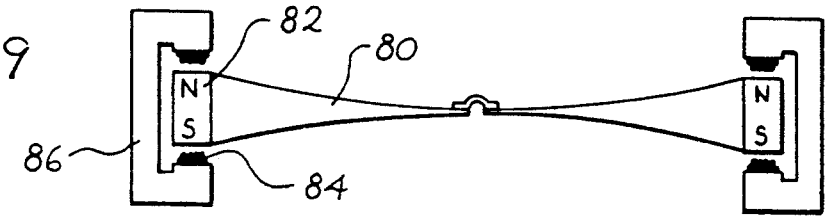
FIG. 9 is an end view of another embodiment similar to FIG. 8.

FIGS. 8 and 9 illustrate two embodiments in which the position of the coils and magnets are reversed. In FIGS. 8, a bar magnet 70 is secured to the hub edge of the radiator 72, with the poles lying in the same plane as the radiator. Coil 74 is wrapped around a support frame in a position to produce a field perpendicular to the magnetic field of the poles. Two side by side units may be employed as discussed in the previous embodiments.

FIG. 9 shows a radiator 80 having a bar magnet 82 with the opposite poles thereof facing longitudinal loops of a continuous coil 84, with sufficient gaps being provided between the magnet poles and the coil. The coil is mounted on opposed inwardly facing surfaces of an elongate C-shaped magnetic path support 86.

In view of the foregoing, it will be appreciated that many other configurations may be employed in a variety of shapes and sizes. Since the thickness of the speaker is less than most conventional speakers, compact versions may be employed where space is at a premium, for example, in automobiles, or in the walls and ceilings of rooms.

Aside from greatly improved efficiencies, and potential frequency range, the speaker of the present invention offers substantial economic advantages over conventional linear drive speakers. Inexpensive bar magnets may be employed, and the radiator is simple to fabricate compared to a speaker cone. No separate suspension system is required, and the suspension is less critical. Better efficiencies allow the use of lower power audio components at lower cost.

In addition, it may be seen that since the conductive portion of the drive, the coil, is spread out over a large surface area, the heat produced by resistance in the coil is dissipated. Also, as shown in FIGS. 8 and 9, the coil may be in intimate contact with a metallic element which serves as a heat sink.

Figure 10:
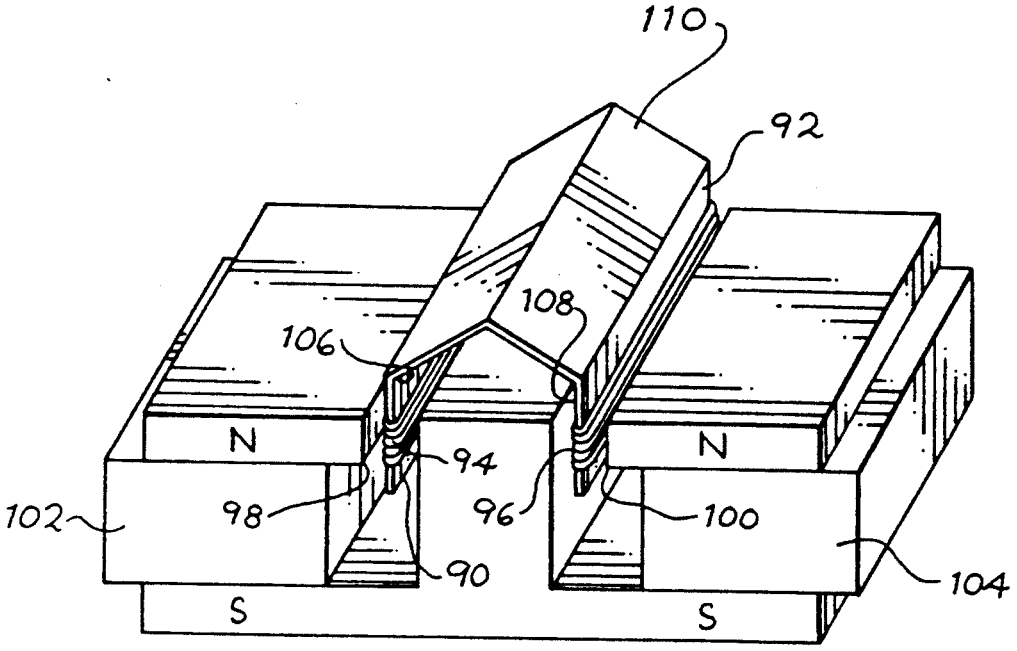
FIG. 10 is a sectional view of yet another embodiment using a secondary radiator.
Figure 11:
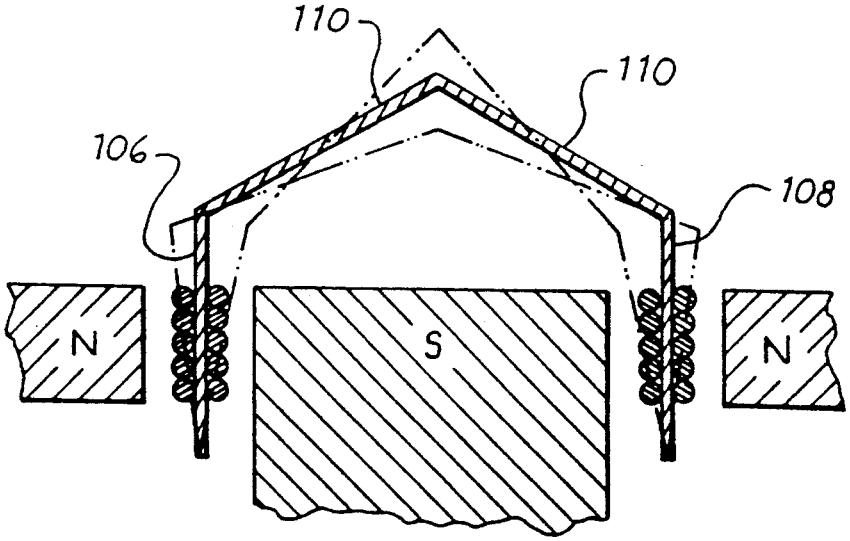
FIG. 11 is an enlarged schematic view of the embodiment shown in the FIG. 10.

FIGS. 10 and 11 show the same types of torque drive being operated to drive a secondary radiator, with two units being employed in parallel. Longitudinally extending torque drive strips 90 and 92 extend in parallel, and each strip has a continuous coil 94 and 96 wrapped around or near one edge, as in the previous embodiments. The coils 94 and 96 are disposed between the opposite poles 98 and 100 of permanent magnets 102 and 104. In the embodiment shown, adjacent sides of the coils 94 and 96 are disposed along a common South pole, and the outside sides of the coils are disposed adjacent to North poles.

The coils 94 and 96 are connected to a common audio source, but in this case, the coils are connected in a manner to cause the free ends 106 and 108 of the respective strips 90 and 92 to move in opposite directions.

A flexible membrane 110, preferably having an outward or concave bulge, is connected between the ends 106 and 108 of the strips. It may be seen that movement of the strip ends 106 and 108 toward each other causes the membrane 110 to flex or bulge outwardly in an exaggerated fashion, as shown by dotted lines. Movement of the strip ends 106 and 108 away from each other causes the membrane to become flatter than its original bulged condition, as shown by the dotted lines. These larger motions of the bulging membrane are similar to a transformer action, converting the smaller motions of the strip ends to larger motions of the membrane.

The embodiment shown in FIGS. 10 and 11 is well suited to the production of high frequency sounds, with the membrane bulge being akin to a tweeter dome in the linear drive. it may be seen, however, that in the present embodiment, a large number of coil windings may be employed to impose very high forces on the membrane, particularly at high frequencies. The dual rotary drive is coupled to the membrane in such a fashion to convert rotary motion into linear motion, while still maintaining the efficiency and benefits of a rotary drive.

Obviously, while the membrane or radiator 110 is shown as having a V-shaped convex section, any convex or outwardly bulging shape may be employed, such as curved shapes. The bulge should be sufficient to allow the ends of the strips 90 and 92 to move away from each other to the maximum desired extent. Also, the width and distance between the strips can be modified to increase or decrease the amount of transformer action.

We claim:

1. A loudspeaker responsive to an electrical signal comprising a substantially rigid radiator having a surface area defined by opposed sides and opposed first and second edges, a conductive coil wrapped around said radiator near said first edge and extending along opposed sides thereof, means for supporting said radiator for rotation about an axis near said first edge generally in parallel with a longitudinal axis of said coil, and magnet means having opposite poles disposed adjacent to the coil at opposite sides thereof, such that an electrical signal on said coil causes torque to be exerted on said radiator around the axis.

2. A device for producing sound in response to an electrical audio signal, said device comprising a pair of spaced strips each having opposed first and second edges, a means mounted on each of said spaced strips near said first edges for importing reversing rotary motion in opposite rotary directions a round respective axes near said first edges response to the audio signal, and a flexible sound radiating membrane connected between the second edges of said strips, said membrane being moved outwardly when said second edges are rotated toward each other.

3. The device of claim 2 wherein said strips are parallel.

4. The device of claim 3 wherein said membrane is convex.

5. A device for producing sound in response to an electrical audio signal, said device comprising a pair of substantially planar radiators, said radiators having first edges closely spaced from each other and second edges remote from and first edges, and a drive means for each of said radiators responsive to said audio signal, a portion of said drive means being mounted on each of said radiators near the second edges thereof and producing a reversing rotary motion in opposite rotary directions around respective axes near said second edges.

6. The device of claim 5 wherein each of said radiators has opposed surfaces, and said drive means comprises a conductive element wrapped around said opposed surfaces substantially parallel to said axis near said second edge and connected to said audio signal.

7. The device of claim 6 wherein said conductive element on opposed surfaces of said radiator are disposed between the opposite poles of a magnet.

8. The device of claim 5 wherein said portion of said drive means mounted on each of said radiators comprises a permanent magnet extending parallel to said axis.

9. The device of claim 8 wherein said drive means further comprises a stationary conductive coil disposed adjacent opposite poles of said magnet.

10. The device of claim 5 wherein the distances between first and second edges of each of said radiators varies along the length of said axis.

11. The device of claim 5 further comprising a horn mounted near one side of said opposed surfaces of said radiators.

12. The device of claim 5 further comprising an enclosure, said radiators being mounted in a face of said enclosure for radiating sound outwardly therefrom.

13. A loudspeaker for producing sound in response to an audio signal, said loudspeaker comprising a rotary vane having a hub, a rotary axis for said vane near said hub, and drive means near said hub for producing rotary motion of said vane, said drive means comprising a coil having a plurality of conductive elements arranged substantially parallel to said axis and connected to said audio signal, and a permanent magnet having at least one pole substantially coextensive with and spaced from said coil, and said coil and said permanent magnet being mounted on said hub.

* * * * *